US009918558B2

(12) United States Patent
Limer

(10) Patent No.: US 9,918,558 B2
(45) Date of Patent: Mar. 20, 2018

(54) MATTRESS WITH AN AIR FLOW CHANNEL

(71) Applicant: Hickory Springs Manufacturing Company, Hickory, NC (US)

(72) Inventor: William B. Limer, Hickory, NC (US)

(73) Assignee: Hickory Springs Manufacturing Company, Hickory, NC (US)

( * ) Notice: Subject to any disclaimer, the term of this patent is extended or adjusted under 35 U.S.C. 154(b) by 0 days.

(21) Appl. No.: 15/205,606

(22) Filed: Jul. 8, 2016

(65) Prior Publication Data

US 2017/0035213 A1 Feb. 9, 2017

Related U.S. Application Data

(63) Continuation of application No. 14/192,644, filed on Feb. 27, 2014, now Pat. No. 9,386,862.

(51) Int. Cl.

| | |
|---|---|
| ***A47C 23/04*** | (2006.01) |
| ***A47C 27/15*** | (2006.01) |
| ***A47C 27/20*** | (2006.01) |
| ***A47C 27/05*** | (2006.01) |
| ***A47C 27/06*** | (2006.01) |

(52) U.S. Cl.

CPC ..... *A47C 27/15* (2013.01); *A47C 27/05* (2013.01); *A47C 27/056* (2013.01); *A47C 27/064* (2013.01); *A47C 27/20* (2013.01)

(58) Field of Classification Search

CPC ..... A47C 27/064; A47C 27/15; A47C 27/148; A47C 27/20; A47C 27/144; A47C 27/056; A47C 27/14; A47C 27/05; A47C 27/146; A47C 27/04; A47C 27/063; A47C 27/062

USPC ..... 5/716–720, 724, 727

See application file for complete search history.

(56) References Cited

U.S. PATENT DOCUMENTS

| | | | | |
|---|---|---|---|---|
| 5,107,558 | A * | 4/1992 | Luck | A47C 27/146 5/702 |
| 5,513,402 | A * | 5/1996 | Schwartz | A47C 23/00 5/691 |
| 6,317,912 | B1 * | 11/2001 | Graebe | A47C 23/047 5/655.3 |
| 6,658,682 | B1 * | 12/2003 | Wells | A47C 27/063 5/655.7 |
| 8,561,236 | B2 * | 10/2013 | Witherell | A47C 27/04 5/716 |
| 8,832,888 | B2 * | 9/2014 | Chunglo | A47C 27/144 5/724 |
| 2006/0096032 | A1 * | 5/2006 | Rensink | A47C 27/001 5/721 |
| 2007/0022540 | A1 * | 2/2007 | Hochschild | A47C 27/001 5/727 |
| 2007/0283501 | A1 * | 12/2007 | Mossbeck | A47C 27/00 5/727 |
| 2013/0283538 | A1 * | 10/2013 | Young | A47C 21/046 5/724 |

(Continued)

*Primary Examiner* — Richard G Davis

(74) *Attorney, Agent, or Firm* — Perkins Coie LLP

(57) ABSTRACT

A foam mattress is provided having a body facing surface comprising a first foam layer on a first spring layer formed of a plurality of individual pocketed spring coils. A second foam layer formed of a reticulated foam supports the first spring layer. The foam mattress further having a bottom layer of conventional foam. The foam mattress is surrounded by a foam casing that has at least one vent formed in the casing. The first spring layer causes air to flow from the second foam layer through the vents.

16 Claims, 7 Drawing Sheets

(56) References Cited

U.S. PATENT DOCUMENTS

2014/0165292 A1* 6/2014 Gladney ..... A47C 27/05
5/717

* cited by examiner

MATTRESS WITH AN AIR FLOW CHANNEL

CROSS-REFERENCE TO RELATED PATENT APPLICATIONS

The present application is a continuation of U.S. patent application Ser. No. 14/192,644, filed Feb. 27, 2014, now U.S. Pat. No. 9,386,862, which is related to U.S. Provisional Patent Application Ser. No. 61/827,180, titled Mattress with a Visco Elastic Polyurethane Foam Layer, filed May 24, 2013, each of which is incorporated by reference as if set out in full.

BACKGROUND

Beds and other support surfaces for the body have been in existence for centuries. From straw and fabric to the highly technical mattresses of today, the industry has sought to improve upon the support for a person at rest in a supine position. People spend, on average, close to ⅓ of their life span asleep. Therefore, the need for comfortable support for the body during the sleep period is highly desirable.

The technology relating to improving mattresses is diverse and includes many designs that are oriented towards individual comfort. Some designs include spring based technology, some designs include air based technology, and some designs include foam based technology.

With specific reference to foam based technology, many mattresses today are constructed either entirely or partially out of foam material. The foam material may include closed cell and/or open cell foams as are generally known in the art. The foam material may be formed from polyurethane foam, for example, or other conventional foams. The polyurethane foams may include conventional polyurethane foam, open cell polyurethane foams, reticulated polyurethane foams, and/or viscoelastic polyurethane foams. Other designs include other foams, including, for example, latex foams and the like. Currently, the industry trends are focusing on types of viscoelastic foams (sometimes generically referred to as "Memory Foam") to increase comfort and support for the individual resting on the bed.

A conventional mattress 100 formed using polyurethane foams is shown in FIG. 1. The mattress 100 conventional includes a top layer 102 and a bottom layer 104. The top layer 102 is generally designed for comfort and may include, for example, the aforementioned viscoelastic foam types, whether polyurethane viscoelastic foam or another viscoelastic foam. The bottom layer 104 is generally for support and may include a closed or open cell structure polyurethane foam. In certain aspects, the mattress 100 may include a layer of breathable or open cell foam 106, such as, for example, foams generally referred to as reticulated polyurethane foams. As used herein, reticulated foams generally refer to foams that allow 5 or more standard cubic feet of air flow per minute.

In some cases, a conventional foam mattress may be formed using a closed or open cell structure polyurethane foam similar to the above for support. Comfort for such a conventional mattress may be improved by adding a "topper" as is generally known in the art. A topper may be formed of viscoelastic polyurethane foam.

However, despite improvements in the types and combination of foams, a need exists in the industry for improved comfort and support for mattresses formed at least partially from foam. Thus, against this background, an improved mattress is desirable.

SUMMARY

This Summary is provided to introduce a selection of concepts in a simplified form that are further described below in the Detailed Description. This Summary, and the foregoing Background, is not intended to identify key aspects or essential aspects of the claimed subject matter. Moreover, this Summary is not intended for use as an aid in determining the scope of the claimed subject matter.

In one aspect, the technology of the present application provides a foam top layer. The foam top layer in certain aspects may be viscoelastic. In other aspects, the foam top layer is latex. In still other aspects, the foam top layer is a viscoelastic foam coated with latex. The top foam layer may be of a closed, an open, or a reticulated cell structure. The top foam may be gel infused and/or contain other elements including phase change materials, antimicrobials, or the like. The foam top layer may comprise a plurality of separate layers stacked or aligned to cooperate with each other. The technology of the present application provides a bottom support layer, which may comprise foam. A layer of springs (used generically) may be provided between the foam top layer and the foam support bottom layer. In at least one aspect, the layer of springs may be provided adjacent the foam top layer. The layer of springs in certain aspects may be a layer of individually pocketed spring coils. The bottom support layer may be of a closed or open cell structure. An intermediate layer of foam having an open cell structure may be provided adjacent the layer of springs and between the layer of springs and the bottom layer. The open cell structure provides for increased breathability and may facilitate the transfer of body heat through the foam top layer. In certain aspects, the technology of the present application provides a foam casing surrounding the sidewalls of the mattress formed by the foam top layer, the layer of springs, the intermediate layer, and the foam support bottom layer. The foam casing may include a vent placing the intermediate layer of foam in fluid communication with the atmosphere such that the layer of springs functions as an air pump to circulate air through the intermediate layer and vent to the atmosphere.

These and other aspects of the present system and method will be apparent after consideration of the Detailed Description and Figures herein.

DRAWINGS

Non-limiting and non-exhaustive embodiments of the present invention, including the preferred embodiment, are described with reference to the following figures, wherein like reference numerals refer to like parts throughout the various views unless otherwise specified.

DETAILED DESCRIPTION

The technology of the present application will now be described more fully below with reference to the accompanying figures, which form a part hereof and show, by way of illustration, specific exemplary embodiments. These embodiments are disclosed in sufficient detail to enable those skilled in the art to practice the technology of the present application. However, embodiments may be implemented in many different forms and should not be construed as being limited to the embodiments set forth herein. The following detailed description is, therefore, not to be taken in a limiting sense.

The technology of the present application is described with specific reference to a mattress construction to support a supine individual, adult, or child. However, the technology described herein may be used for other structures where comfort and support are desirous such as, for example, chairs, hammocks, vehicle seats, and the like. Moreover, the technology of the present application will be described with relation to exemplary embodiments. The word "exemplary" is used herein to mean "serving as an example, instance, or illustration." Any embodiment described herein as "exemplary" is not necessarily to be construed as preferred or advantageous over other embodiments. Additionally, unless specifically identified otherwise, all embodiments described herein should be considered exemplary.

Figure 1:
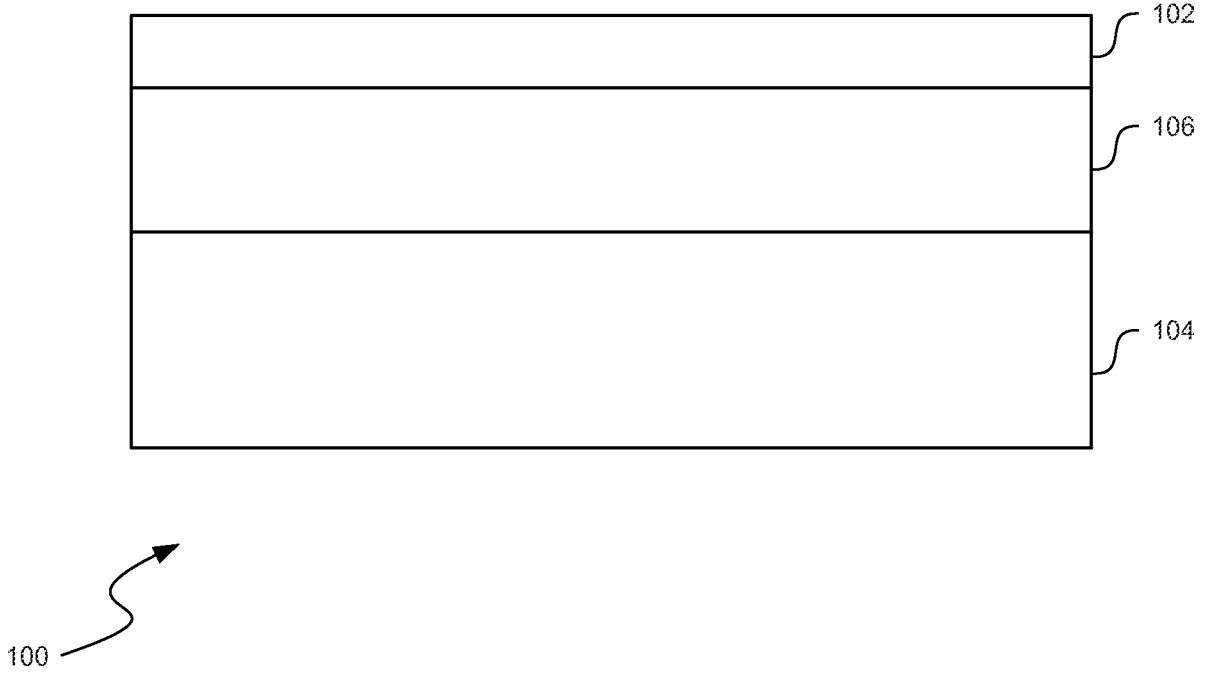
FIG. 1 (Prior Art)
FIG. 1 depicts a cross sectional view of a conventional mattress construction.
Figure 2:
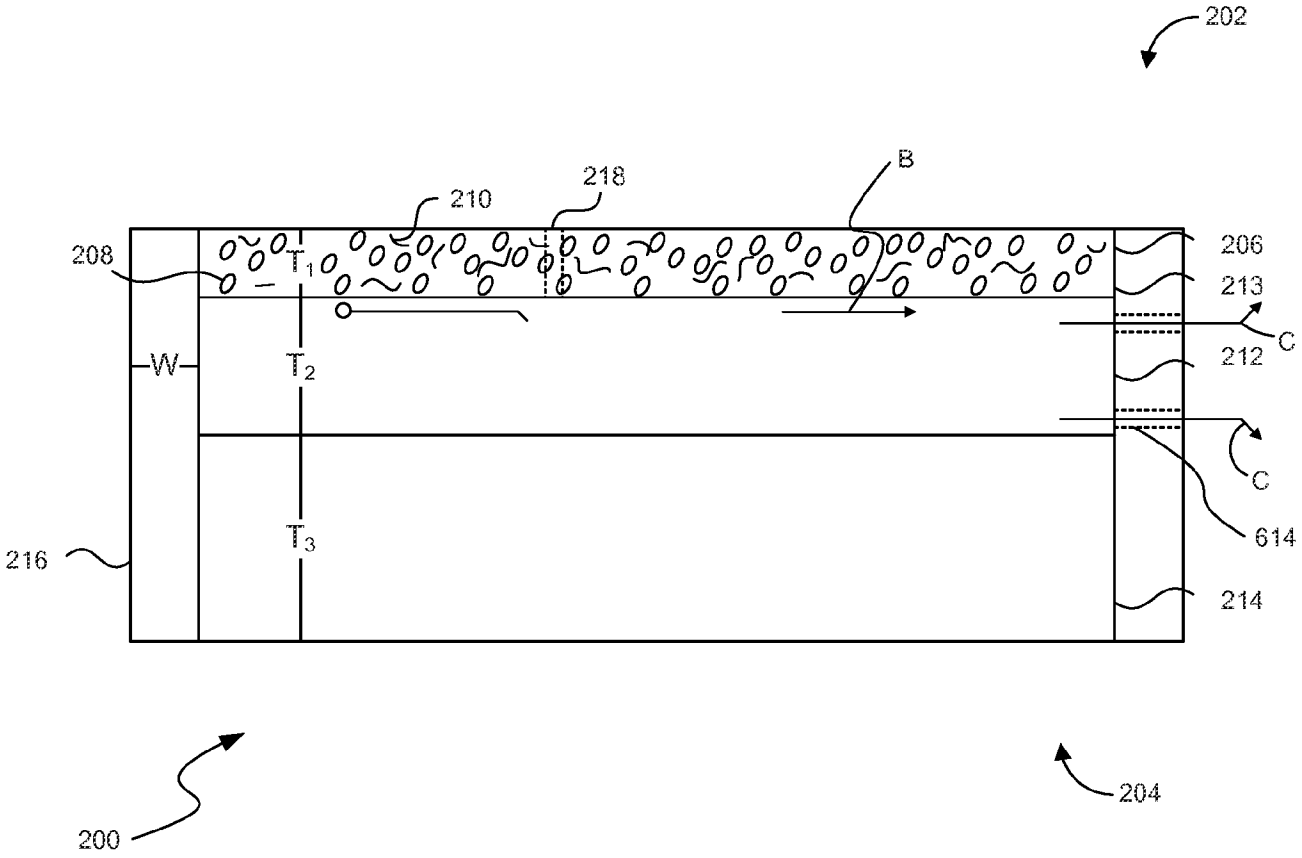
FIG. 2 depicts a cross sectional view of a mattress constructed in accordance with an aspect of the present technology.

With reference now to FIG. 2, a mattress 200 consistent with the technology of the present application is provided. The mattress 200 is shown in cross-section for ease of reference. The mattress 200 has a top side 202, which may be referred to as the body facing side, and a bottom side 204. The designations of top and bottom are provided for orientation and should not be considered limiting in and of themselves. From body facing or top side 202 to bottom side 204, the mattress 200 is provided with a first layer of foam ("first foam layer") 206, a second layer of foam ("second foam layer") 212, and a third layer of foam ("third foam layer") 214.

The first foam layer 206, in this exemplary embodiment, may comprise a viscoelastic polyurethane foam for comfort and support. While any conventional viscoelastic foams may be used, the first foam layer 206 may be either a closed cell or an open cell viscoelastic foam. Open cell viscoelastic foams may provide increased breathability, which may facilitate heat transfer. In certain aspects, the viscoelastic foam may be a "gel foam." Gel foams are formed by infusing the foam layer with a gel, which may be, for example, a polyol gel or the like. The gel infused foam, such as, for example, PRESERVE VG® available from Hickory Springs Manufacturing Company of Hickory, N.C., facilitates heat transfer to reduce the heat retention tendencies of viscoelastic foams. The gel may be formed into beads and added to the foam.

Viscoelastic foam generally conforms to a shape based on pressure and heat, such as body weight (or mass) and body heat. The viscoelastic first foam layer 206 may have a density between about 1.5 to about 7.5 pounds/cubic foot. The term "about" in this instance means within a tolerance of ±15%. The viscoelastic first foam layer 206 may further have a hardness of about 9 to about 14 indentation load deflect (generally known as "ILD" in the industry). The first foam layer 206 has an uncompressed thickness of approximately 1.25 to 10 cm (approximately 0.5 to 4 inches). The mattress 200 shown in FIG. 2 provides a first foam layer 206 with a thickness $T_1$ of approximately 1 inch. In another exemplary embodiment, associated with FIG. 4 below, the first foam layer may be, for example, 0.75 inches.

In an alternative embodiment, the first foam layer 206 may comprise a latex foam layer. For example, the first foam layer 206 may comprise a latex foam layer having an indentation load deflection (ILD), which is a general measure of latex foam firmness, of between about 14 ILD and 30 ILD. The first foam layer in the present example may be between about 2.5 cm to 15 cms (approximately 1 to 6 inches) in thickness. In a particular exemplary embodiment, the first foam layer 206 was formed from a 2 inches thick latex foam having 19 ILD. Latex foams may have open or closed cellular structures, which impacts the foams breathability. In certain embodiments, the first foam layer 206 may include one or more holes punched through the foam layer from the body facing side to the side opposite the body facing side as shown in phantom by a single representative hole 218.

The first foam layer 206 may include phase change materials ("PCM") 208 as are generally known in the art. PCMs change phase from solids to liquids at the latent heat of phase change for the material (for example, the latent heat of phase change for ice is 32° F. at 1 atmosphere). Certain PCMs, such as paraffin waxes, change phase at a temperature that tends to maintain objects close to the body at a comfortable temperature. PCMs are further described in, for example, U.S. Pat. Nos. 5,499,460 and 5,637,389, both of which are incorporated herein by reference as if set out in full. The first foam layer 206 may further include antimicrobial materials 210. Antimicrobial materials 210, such as, for example, silver fibers, nanoparticles, or the like, enhance the ability of the first foam layer 206 to resist bacterial growth and the like.

As mentioned above, foams have a tendency to retain heat. In the case of viscoelastic foams, the heat allows the viscoelastic foam to flow and form to a body contour but still may become uncomfortable after prolonged exposure to body heat. A second layer 212 may be provided to facilitate heat flow. Conventionally, the second layer 212 may be provided as an open cell or reticulated foam product. Generally, reticulated foams for the present purposes include foams where the air flow volume through the foam is greater than approximately 5 standard cubic feet/minute. The open cell structure provides for a high flow of gas through the foam enhancing the foams breathability. Generally, the second foam layer 212 has an uncompressed thickness $T_2$ of approximately 1.25 to 10 cm. The uncompressed thickness of second foam layer 212 may be of approximately the same thickness as the first foam layer 206. In some embodiments, the second foam layer 212 may be thinner than first foam layer 206. Alternatively, the second foam layer 212 may generally be thicker, such as 2× or 3× thicker, than the first foam layer 206. The open cell second foam layer 212 provides a heat sink for the first foam layer 206. The second foam layer 212 may have a density of about 1.5 to 3 pounds/cubic foot and an ILD of about 10 to 60.

As shown, the first foam layer 206 is placed directly on and aligned with the second foam layer 212. However, intermediate fabrics or foams may be placed between the first and second foam layers 206, 212. In certain instances, for example, a waterproof/breathable fabric 213 may be placed between the layers to allow the flow of gases but inhibit the flow of liquids. Such waterproof/breathable fabrics include GORE-TEX® fabrics such as are available from W.L. Gore & Associates.

The first and second foam layers 206, 212 are supported by a third foam layer 214. Generally, the third foam layer 214 is a conventional polyurethane foam. For the present purposes, the conventional polyurethane foam allows air flow through the foam at approximately 0 to 5 standard cubic feet/minute. For clarity, in the present application, reticulated foam means a non-viscoelastic, open foam cellular structure with air flow greater than about 5 SCF/M and open cell foam means a non-viscoelastic, open or closed, foam cellular structure with air flow less than about 5 SCF/M. As can be appreciated from the above, however, viscoelastic foams also can be closed, open, or reticulated foams. The third foam layer 214 is generally the thickest layer and fills out the bulk of the mattress. The uncompressed thickness $T_3$ may range from up to about 12 cm to about 28 cm (which is about 5 inches to about 11 inches) and depends somewhat on the thickness of the first and second foam layers 206, 212 and whether the mattress is a twin, double, queen, king, or the like. In one exemplary embodiment, the third foam layer 214 was about 6 inches thick.

Generally, the mattress 200 may be boarded by foam sidewalls 216. The foam sidewalls generally have a width W of about 5 cm to 10 cm (or 2 to 4 inches). The constructed mattress 200 provides foam sidewalls 216 of a width of about 7.5 cm (or 3 inches). Generally, the foam sidewalls 216 in this exemplary embodiment are reticulated polyurethane foam, as the foam sidewalls 216 are not required to provide a significant amount of body support. The foam sidewalls 216 being constructed as reticulated foam facilitate the breathability of the mattress 200 and act generally as a heat sink.

Figure 3:
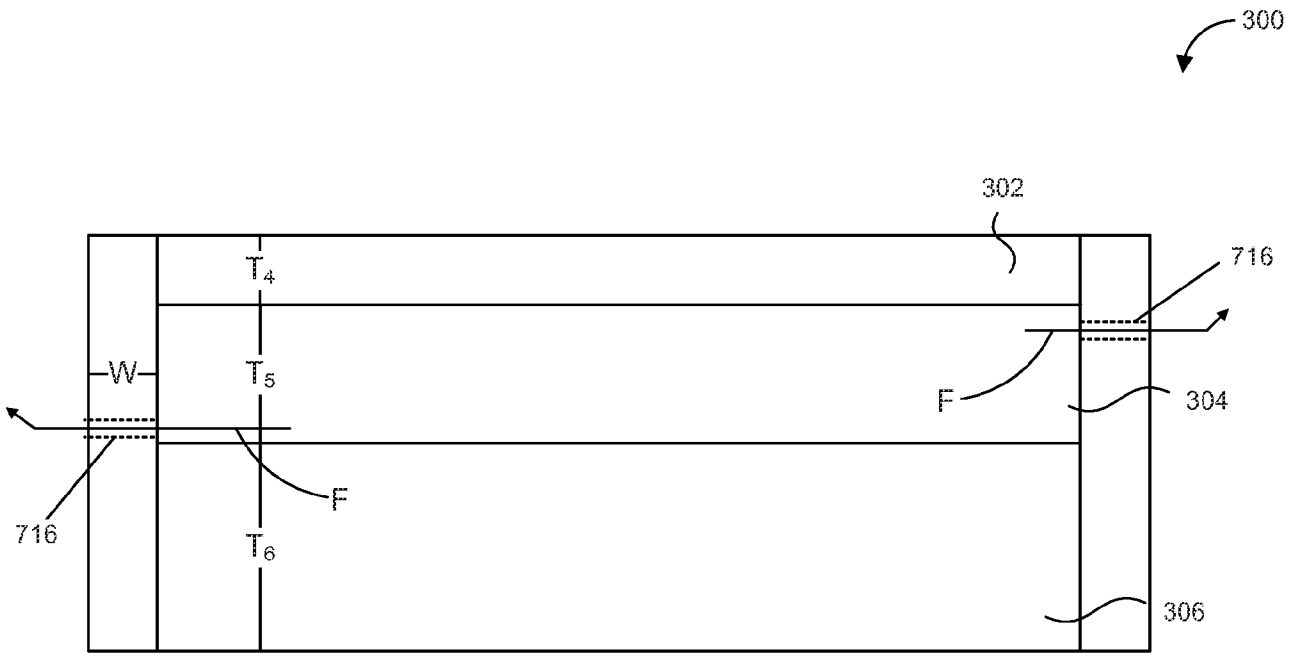
FIG. 3 depicts a cross sectional view of a mattress constructed in accordance with an aspect of the present technology.

With reference now to FIG. 3, a foam mattress 300 is provided. The foam mattress 300 is similar to the foam mattress 200 and comprises a first foam layer 302, a second foam layer 304, and a third foam layer 306. The first foam layer 302 comprises a viscoelastic foam layer similar to first foam layer 206. The first foam layer 302 has a thickness $T_4$ that is approximately 1 inch thick (or about 2.5 cm). In this exemplary embodiment, the second foam layer 304 of the foam mattress 300 comprises an open cell foam. The second foam layer 304 has a thickness $T_5$ that is approximately 2× the thickness of the first foam layer 302, or approximately 2 inches thick (or about 5 cm). Finally, the third foam layer 306, which is a conventional polyurethane foam, has a thickness $T_6$ that is approximately 7 inches thick (or about 17-18 cm). The mattress 300 is similarly encompassed by a foam sidewall 308. The sidewall 308 has a width that is approximately 3 inches.

Figure 4:
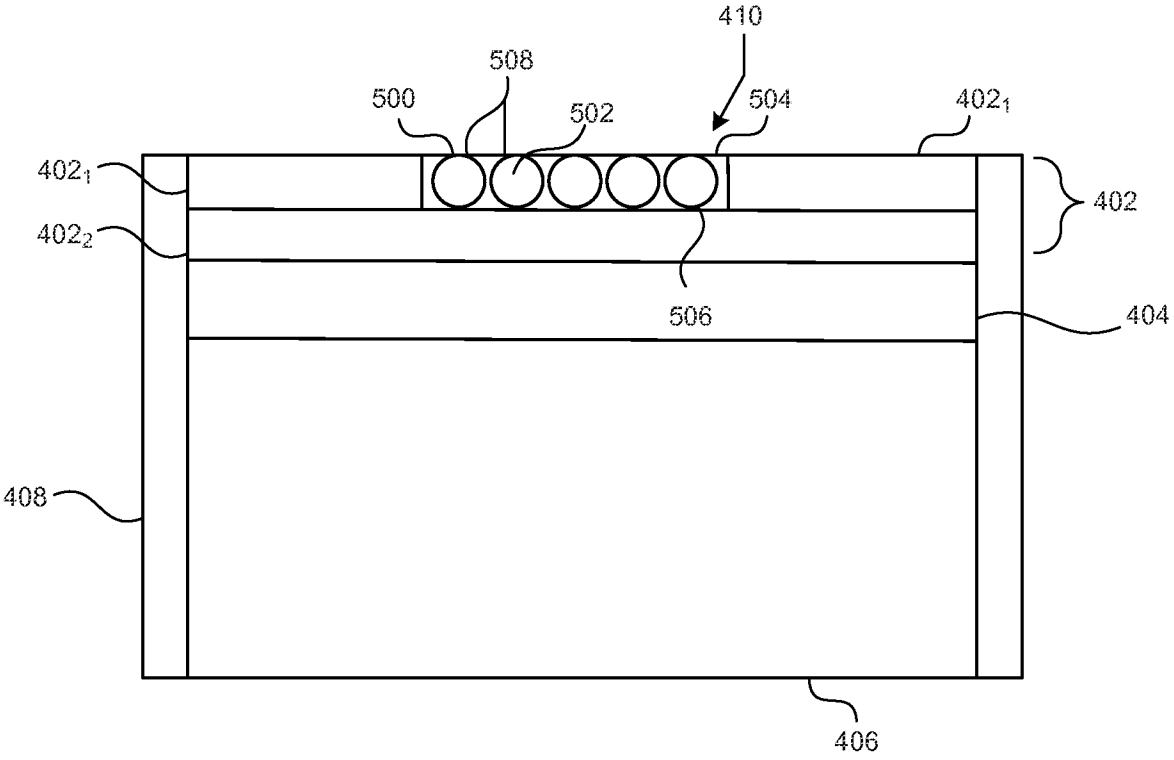
FIG. 4 depicts a cross sectional view of a mattress constructed in accordance with an aspect of the present technology.

With reference now to FIG. 4, a mattress 400 consistent with the technology of the present application is provided. The mattress 400 comprises a first foam portion 402, a second foam layer 404, and a third foam layer 406, all of which are surrounded by a foam sidewall 408. As shown in the cross-sectional view of FIG. 4, the first foam portion 402 is provided with a space 410, which may be a cavity, recess, or depression. The space 410 is approximately centered on mattress 400. As can be appreciated, the first foam portion 402 may be formed with the cavity 410 as a single slab of foam. However, it is more cost effective to provide the first foam portion 402 in two layers of foam $\mathbf{402}_1$ and $\mathbf{402}_2$. The first top foam layer $\mathbf{402}_1$ comprises a plurality of slabs or panels of foam placed on second top foam layer $\mathbf{402}_2$ where the second top foam layer $\mathbf{402}_2$ comprises a single slab of foam. A layer 500 comprising pocketed spring coils 502 is provided in the cavity 410.

Figure 5:
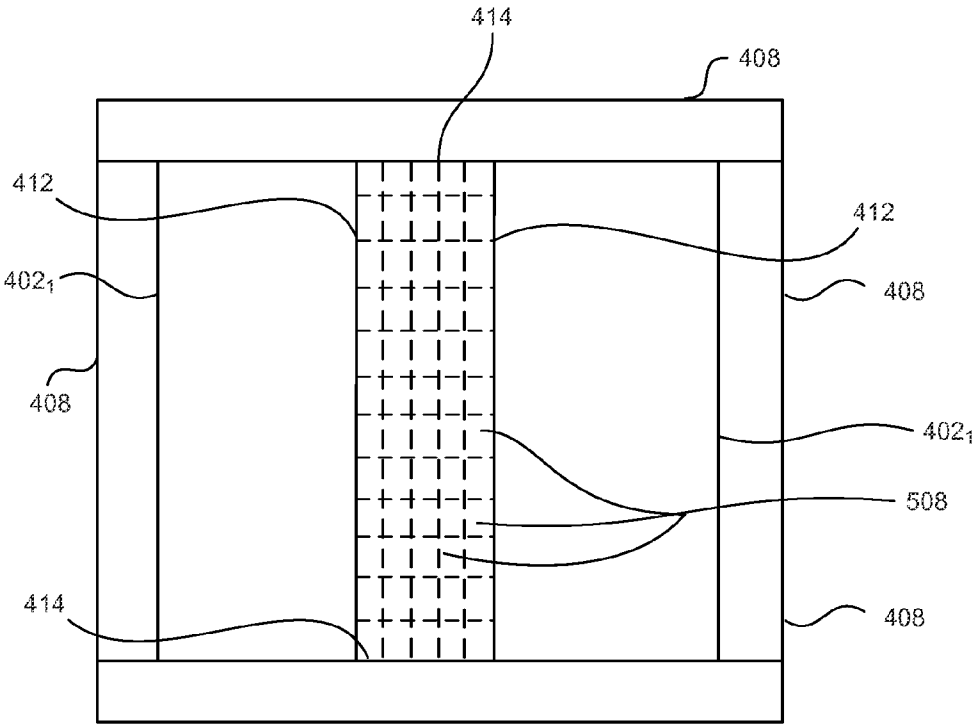
FIG. 5 depicts a top elevation view of the mattress of FIG. 4.

As shown in FIG. 5, which is a plan view of the mattress 400, the first top foam layers $\mathbf{402}_1$ are placed spaced apart by the space 410 such that the cavity is bounded by an inner surface 412 of the first foam layers and an inner surface 414 of the foam sidewalls 408. Alternatively, a plurality of first top foam layers $\mathbf{402}_1$ may be placed such that the space 410 is bounded by inner surfaces 412 of the first top foam layers $\mathbf{402}_1$ on all sides.

With reference back to FIG. 4, the layer 500 includes a plurality of individually pocketed spring coils 502. The layer 500 includes a top fabric 504 and a bottom fabric 506 that are adhered together in a pattern that produces pockets 508 (see FIG. 5). The fabrics 504, 506 can generally be any type of textile, woven or non-woven. The adhering of the top and bottom fabrics 504, 506 may be through stitching, welding, gluing, or the like. The pockets 508 or voids hold spring coils 502. The individual springs provide increased support and comfort over, for example, innerspring coil core or the like.

Construction of the layer 500 typically results in a layer 500 having a thickness of approximately 1.3 cm to 6.4 cm (or about 0.5 inches to 2.5 inches). The exemplary construction of mattress 400 resulted in the layer 500 having a thickness of approximately 2 cm (or 0.75 inches). Thus, the depth of the space 410, or the depth of the recess, needs to be approximately 2 cm in this exemplary embodiment. If the first foam portion 402 is formed by a first and second top foam layer $\mathbf{402}_1$, $\mathbf{402}_2$, then the first top form layer $\mathbf{402}_1$ is sized with a thickness equal to the thickness of the layer 500. The second top foam layer $\mathbf{402}_2$ is sufficiently thick to provide the effective comfort of the viscoelastic foam about where the layer 500 resides. In the exemplary embodiment constructed, the thickness of the second top foam layer $\mathbf{402}_2$ is approximately 3 to 3.5 cm (or about 1.25 inches in the above exemplary embodiment). Thus, the thickness of the first foam portion 402 is approximately 5 to 6 cm (which is about 2 inches).

Figure 6:
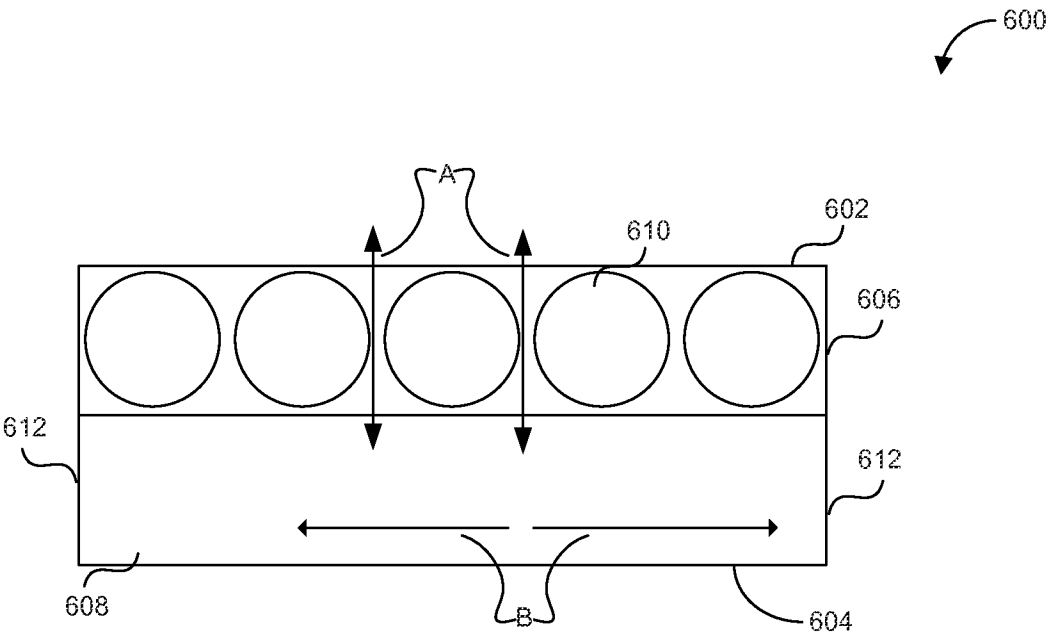
FIG. 6 is a cross sectional view of an intermediate layer in accordance with an aspect of the present technology.

With reference to FIG. 6, an intermediate layer 600 is provided. Intermediate layer 600 may be used in the constructions of FIGS. 2, 3, and 4 as the second foam layer 206, the second foam layer 304, or the second foam layer 404. The intermediate layer 600 will be described with reference to FIG. 2 and second foam layer 206 for convenience, but the intermediate layer 600 could similarly be used in the other foam layers as described. The intermediate layer 600 includes a body facing side 602 (which may be referred to as the top side) and a ground facing side 604 opposite the body facing side 602 (which ground facing side may be referred to as the bottom side). The body facing side 602 is adjacent the sleeping surface or top surface of the mattress. The intermediate layer 600 is formed of at least two layers 606, 608. The layer 606, adjacent the body facing side 602, is formed of a plurality of spring coils 610, such as, for example, the aforementioned plurality of individually pocketed spring coils 502 discussed above with respect to FIGS. 4 and 5. The layer 606 formed from a plurality of spring coils 610, such as the pocketed spring coils 502, may have a thickness $T_7$ of between about 1.3 cm to about 6.4 cm (or about 0.5 inches to about 2.5 inches). In one exemplary embodiment, the layer 606 is approximately 1.5 inches thick.

The layer 608 is formed from an open cellular foam structure and is preferably a reticulated foam. In one example, the layer 608 is a reticulated polyurethane foam. The layer 608 may be between about 1.3 cm to about 6.4 cm (or about 0.5 inches to about 2.5 inches). In one exemplary embodiment, the layer 608 is approximately 1 inch thick. As an individual moves on the mattress, such as by sitting, laying, rolling, etc., the plurality of spring coils 610 move up and down, as shown by arrows A. The up and down movement (or compression and expansion) of the coils acts as an air pump moving air in a direction towards the outer edges 612 of the layer 608 as shown by arrows B. With reference back to FIG. 2, for example, when intermediate layer is used for second foam layer 206, the air flow shown by arrows B moves through foam sidewalls 216 (sometimes referred to as a casing) as shown by arrows C. The second foam layer 608 and the sidewalls 216 form an air channel. The foam sidewalls 216 are generally open cell or reticulated foams that allow air flow. However, to facilitate air flow, foam sidewalls 216 may have one or more vents 614 punched or formed in the sidewalls to facilitate the air movement.

Figure 7:
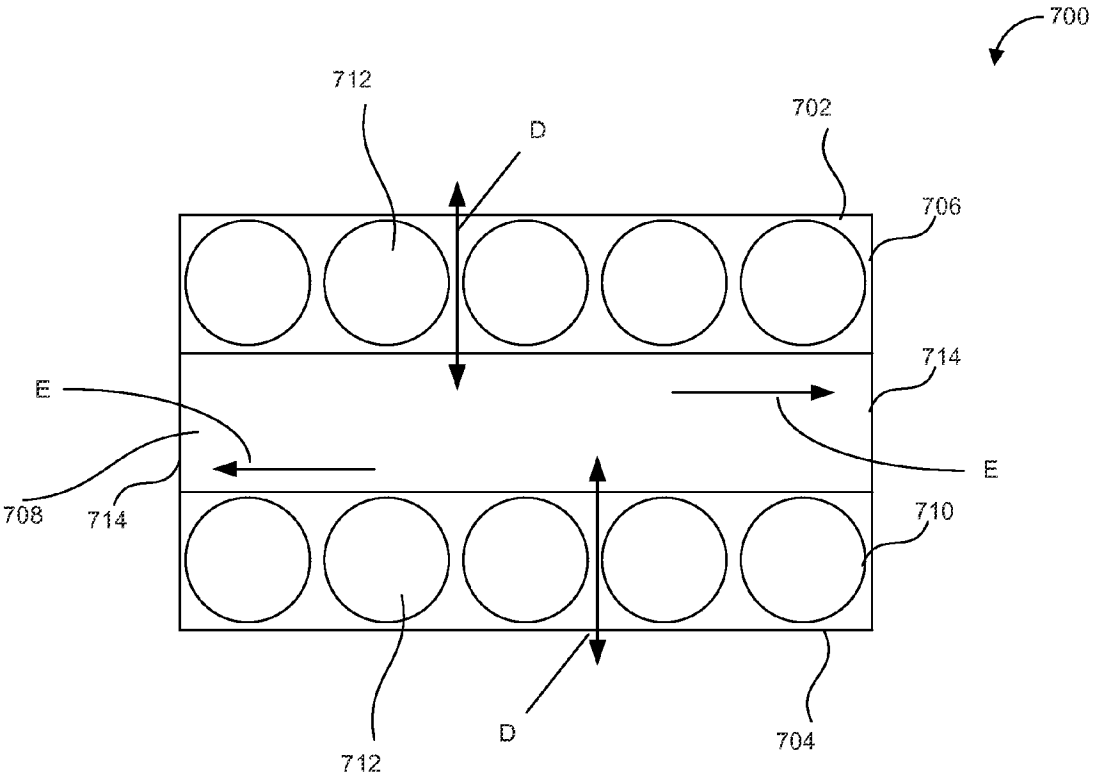
FIG. 7 is a cross sectional view of an intermediate layer in accordance with an aspect of the present technology.

With reference to FIG. 7, an intermediate layer 700 is provided. Intermediate layer 700 may be used in the constructions of FIGS. 2, 3, and 4 as the second foam layer 206, the second foam layer 304, or the second foam layer 404. The intermediate layer 700 will be described with reference to FIG. 3 and second foam layer 304 for convenience, but the intermediate layer 700 could similarly be used in the other foam layers as described. The intermediate layer 700 includes a body facing side 702 (which may be referred to as the top side) and a ground facing side 704 opposite the body facing side 702 (which ground facing side may be referred to as the bottom side). The body facing side 702 is adjacent the sleeping surface or top surface of the mattress. The intermediate layer 700 is formed of at least three layers 706, 708, and 710. The layer 706, adjacent the body facing side 702, and the layer 710, adjacent the ground facing side 704, are formed of a plurality of spring coils 712, such as, for example, the aforementioned plurality of individually pocketed spring coils 502 discussed above with respect to FIGS. 4, 5, and 6. The layers 706, 710 formed from the plurality of spring coils 710, such as the pocketed spring coils 502, each may have a thickness $T_8$ of between about 1.3 cm to about 6.4 cm (or about 0.5 inches to about 2.5 inches). In one exemplary embodiment, the layer 706 and 710 are approximately 1.5 inches thick.

The layer 708 is formed from an open cellular foam structure and is preferably a reticulated foam. In one example, the layer 708 is a reticulated polyurethane foam. The layer 708 may be between about 1.3 cm to about 6.4 cm (or about 0.5 inches to about 2.5 inches). In one exemplary embodiment, the layer 708 is approximately 1 inch thick. As an individual moves on the mattress, such as by sitting, laying, rolling, etc., the plurality of spring coils 712 move up and down, as shown by arrows D. The up and down movement (or compression and expansion) of the coils acts as an air pump moving air in a direction towards the outer edges 714 of the layer 708 as shown by arrows E. With reference back to FIG. 3, for example, when intermediate layer is used for second foam layer 304, the air flow shown by arrows E moves through foam sidewalls 216 (sometimes referred to as a casing) as shown by arrows F. The foam sidewalls 216 are generally open cell or reticulated foams that allow air flow. However, to facilitate air flow, foam sidewalls 216 may have one or more vents 716 punched or formed in the sidewalls to facilitate the air movement.

Although the technology has been described in language that is specific to certain structures and materials, it is to be understood that the invention defined in the appended claims is not necessarily limited to the specific structures and materials described. Rather, the specific aspects are described as forms of implementing the claimed invention. Because many embodiments of the invention can be practiced without departing from the spirit and scope of the invention, the invention resides in the claims hereinafter appended. Unless otherwise indicated, all numbers or expressions, such as those expressing dimensions, physical characteristics, etc., used in the specification (other than the claims) are understood as modified in all instances by the term "approximately." At the very least, and not as an attempt to limit the application of the doctrine of equivalents to the claims, each numerical parameter recited in the specification or claims that is modified by the term "approximately" should at least be construed in light of the number of recited significant digits by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10, that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

What is claimed is:

1. A mattress comprising in order from a body facing surface to a ground facing surface at least a first, a second, and a third layer, the first layer having a first thickness separating a body facing side and a ground facing side opposite the body facing side, wherein the body facing side of the first layer is the body facing surface, the first layer comprising a first foam defining a cavity and a layer of a plurality of individually pocketed spring coils sized to operatively fit into the cavity wherein the layer of the plurality of individually pocketed spring coils has a thickness of no more than 2.5 inches;

the second layer comprising a first spring layer proximal to the ground facing side of the first foam layer and a second foam layer, wherein the second foam layer underlies the first spring layer and comprises a non-viscoelastic, reticulated cell foam that is separated from the first foam of the first layer by the first spring layer and proximal to the third layer, the second layer having a body facing side proximal the ground facing side of the first layer and the second layer having a ground facing side opposite the body facing side; the second layer having a second thickness;

the third layer comprising a third foam layer having a third thickness greater than both the first and second thicknesses, the third foam layer having a body facing surface proximal the ground facing side of the second layer and a ground facing side opposite the body facing surface, wherein the ground facing side of the third layer is the ground facing surface of the mattress;

a foam sidewall extending from the body facing surface of the first layer to the ground facing surface of the third layer, wherein the foam sidewall comprises a reticulated cell foam at least proximal to the second foam layer, wherein the second foam layer of non-viscoelastic, reticulated cell foam and at least a portion of the foam sidewall aligned with the second foam layer form an air channel.

2. The mattress of claim 1 wherein the foam sidewall comprises reticulated foam.

3. The mattress of claim 1 wherein the foam sidewall comprises at least one vent formed in the foam sidewall such that the vent is aligned with the second foam layer.

4. The mattress of claim 1 wherein the first foam comprises viscoelastic foam.

5. The mattress of claim 4 wherein the viscoelastic foam is reticulated.

6. The mattress of claim 4 wherein the viscoelastic foam is infused with a polyurethane gel.

7. The mattress of claim 4 wherein the viscoelastic foam comprises a plurality of polyurethane gel beads.

8. The mattress of claim 1 wherein the second layer comprises a second spring layer proximal the third layer and wherein the second spring layer is separated from the first spring layer by the second foam layer.

9. A mattress having a top proximal a sleeping surface and a bottom distal the sleeping surface, the mattress comprising, a first foam layer having a top side and a bottom side opposite the top side, the first foam layer having a thickness of at least 2 cm, wherein the top side of the first foam layer forms the sleeping surface;

a first spring layer having a top side and a bottom side opposite the top side wherein the top side is adjacent the bottom side of the first foam layer, the first spring layer comprising a breathable material and a plurality of pocketed spring coils; the first spring layer having a thickness less than 6.4 cm;

a second foam layer having a top side and a bottom side opposite the top side wherein the top side is proximal to the bottom side of the first spring layer, the second foam layer formed of a non-viscoelastic, open cellular structure foam, the second foam layer having a thickness of at least 2 cm and allows an air flow of at least 5 standard cubic feet/minute;

a third foam layer having a top side and a bottom side opposite the top side wherein the top side is proximal to the bottom side of the second foam layer, the third foam layer having a thickness of at least 10 cm; the third foam layer comprising at least one of a generally closed or open cell, foam structure; and an outside foam casing substantially surrounding the first, second, and third foam layers, the outside foam casing having a width of at least 5 cm, the outside foam casing placing the second foam layer in fluid communication with the atmosphere, such that compression and extension of the first spring layer causes air flow from the second foam layer to atmosphere.

10. The mattress of claim 9 wherein the first foam layer comprises at least a viscoelastic foam.

11. The mattress of claim 10 wherein the viscoelastic foam comprises a reticulated viscoelastic foam.

12. The mattress of claim 9 wherein the first foam layer comprises a latex foam.

13. The mattress of claim 12 wherein the latex foam comprises at least one through hole formed in the first foam layer.

14. The mattress of claim 9 wherein the outside foam casing comprises at least one vent formed in the outside foam casing wherein the at least one vent is aligned with the second foam layer.

15. The mattress of claim 9 wherein the first foam layer further comprises at least one recess and a second layer of a plurality of individually pocketed spring coils in the at least one recess.

16. The mattress of claim 9 wherein the mattress further comprises a second spring layer between the second foam layer and the third foam layer, the second spring layer having a top side and a bottom side opposite the top side, the second spring layer comprising a breathable material and a plurality of pocketed spring coils; the second spring layer having a thickness less than 6.4 cm.

* * * * *